US008091376B2

(12) United States Patent
Bianchi et al.

(10) Patent No.: US 8,091,376 B2
(45) Date of Patent: Jan. 10, 2012

(54) BENT COIL FOR DUCTED UNIT

(75) Inventors: Carlambrogio Bianchi, Milan (IT); Massimiliano Tonin, Milan (IT); Davide Baio, Lecco (IT)

(73) Assignee: Carrier Corporation, Farmington, CT (US)

( * ) Notice: Subject to any disclaimer, the term of this patent is extended or adjusted under 35 U.S.C. 154(b) by 1402 days.

(21) Appl. No.: 11/190,551

(22) Filed: Jul. 27, 2005

(65) Prior Publication Data

US 2006/0000585 A1 Jan. 5, 2006

Related U.S. Application Data

(63) Continuation-in-part of application No. 10/725,359, filed on Dec. 1, 2003.

(51) Int. Cl.
*F25D 21/14* (2006.01)
*F28D 7/02* (2006.01)

(52) U.S. Cl. ..... 62/291; 165/126

(58) Field of Classification Search ..... 62/291; 165/126

See application file for complete search history.

(56) References Cited

U.S. PATENT DOCUMENTS

| | | | | |
|---|---|---|---|---|
| 1,287,444 A | | 1/1931 | French | |
| 1,787,444 A | | 1/1931 | French | 165/72 |
| 2,022,523 A | | 7/1934 | Roessler | |
| 2,995,906 A | | 8/1961 | Brandimarte | 62/427 |
| 3,313,342 A | | 4/1967 | Laing | 165/124 |
| 3,759,321 A | | 9/1973 | Ares | 165/125 |
| 4,658,602 A | | 4/1987 | Giberson et al. | |
| 4,909,319 A | | 3/1990 | Ishikawa et al. | 165/151 |
| 4,962,882 A | * | 10/1990 | Sarazen et al. | 236/49.5 |
| 5,062,280 A | | 11/1991 | Martin, Sr. | |
| 5,174,366 A | | 12/1992 | Nagakura et al. | 165/77 |
| 5,195,332 A | | 3/1993 | Sullivan | 62/291 |
| 5,228,197 A | | 7/1993 | Cox et al. | 29/890.035 |
| 5,482,115 A | | 1/1996 | Ikeya et al. | 165/151 |
| 5,947,195 A | | 9/1999 | Sasaki | |

FOREIGN PATENT DOCUMENTS

| | | |
|---|---|---|
| EP | 0 395 535 | 7/1992 |
| FR | 2 567 256 | 7/1984 |

* cited by examiner

*Primary Examiner* — Steven B McAllister

*Assistant Examiner* — Helena Kosanovic

(74) *Attorney, Agent, or Firm* — Carlson Gaskey & Olds, P.C.

(57) ABSTRACT

A bent coil used in a ducted heating and cooling unit improves heat exchange. The bent coil increases the overall surface area of the coil for a given duct volume. Openings in a separation wall focus an air flow from fans towards the bent coil. Fins direct the air through the bent coil, and a net removes turbulence from the air flow prior to moving through the bent coil. The bent coil discharges air both longitudinally and laterally, eliminating the need for any additional ducting downstream from the bent coil to divert air toward the sides.

26 Claims, 4 Drawing Sheets

BENT COIL FOR DUCTED UNIT

REFERENCE TO RELATED APPLICATIONS

This application is a continuation-in-part of U.S. patent application Ser. No. 10/725,359 filed on Dec. 1, 2003.

BACKGROUND OF THE INVENTION

The present invention relates to heating and cooling systems, and more particularly to a ducted unit in a system including a bent coil having fins and a separation wall including openings that direct air through the ducted unit.

Heating and cooling systems may include a ducted unit 100 having a fan 102 and a flat coil 104 disposed inside a duct 106 (FIG. 1). Depending on the desired unit characteristics, the fan 102 may be disposed either downstream with respect to the flat coil 104 (i.e., a "draw through" architecture) or upstream with respect to the flat coil 104 (i.e., a "blow through" architecture). As is known in the art, the fan 102 directs air through the duct 106 and through the flat coil 104. The air can be heated or cooled as it travels through the flat coil 104. The flat coil 104 is designed to have a large surface area exposed to the air to optimize heat exchange with the air.

Normally, the flat coil 104 has a flat profile and is disposed either vertically or at an incline with respect to a vertical axis in the duct 106 (FIG. 1). Regardless of whether the flat coil 104 is vertical or inclined, the surface of the flat coil 104 delivers outlet air straight forward in both cases. While the flat coil 104 structure is acceptable if air is discharged straight through the duct 106, it is less effective if the air is to be delivered at an angle (e.g., toward the sides of the duct 106). To discharge air from the sides, a ducted unit 100 having a blow-through architecture often requires one or more additional side ducts 108 downstream of the flat coil 104 to redirect the air. However, the side ducts 108 make installation of the system in, for example, a residence more complicated. Further, as can be seen in FIG. 1, the side ducts 108 increase the overall system dimensions, making them difficult to install in small areas (e.g., corridors).

There are several drawbacks to prior ducted units 100. For example, any turbulence in the air flow directed through the flat coil 104 reduces the effectiveness of the flat coil 104. In addition, a portion of the air directed towards the flat coil 104 may not pass through the flat coil 104. This air may move around the perimeter of the flat coil 104, reducing the overall efficiency of the unit 100. Also, because the flat coil 104 is designed to discharge air only in a forward direction, air that is directed laterally into the side ducts 108 will experience pressure losses, reducing the overall efficiency of the ducted unit 100.

There is a desire for a compact structure that allows the ducted unit to discharge air laterally as well as forward without the efficiency losses encountered in currently known systems as well as overcome other shortcomings and drawbacks of the prior art.

SUMMARY OF THE INVENTION

The present invention provides a compact structure that allows a ducted unit to discharge air laterally as well as forward without efficiency losses encountered in currently known systems. The present invention includes a ducted unit incorporating a bent coil. The bent coil increases the overall surface area of the coil for a given duct volume, improving the heat exchange characteristics of the coil. The bent coil discharges air in multiple directions, both longitudinally and laterally, eliminating the need for any additional ducting downstream from the coil to divert air through discharge openings in the sides of the ducted unit. As a result, air can be directed in multiple directions while keeping the overall dimensions of the ducted unit compact.

A ducted unit incorporating the inventive bent coil according to one embodiment of the invention includes two fans and a bent coil that is arranged downstream from the fans, both of which are disposed in a duct. Air from the fans flow through openings in a separation wall that direct the air towards the bent coil. The air then travels through the bent coil and is cooled or heated. The bent coil includes fins that assist in diverting the air through the bent coil, facilitating consistent air flow distribution through the bent coil and the diversion of air through side discharge openings in the ducted unit. The fins also equalize the air flowing through the bent coil, thus improving heat exchange in the bent coil and the overall noise performance.

In addition, a net may be used to further equalize the air flow through the bent coil. The net lessens the turbulence in the air prior to entering the bent coil, thus improving the heat exchange and noise performance of the bent coil.

The present invention therefore provides lateral air flow through the sides of the ducted unit without requiring additional ductwork and more efficient cooling or heating of air as it moves across the coil.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE EMBODIMENTS

Figure 1:
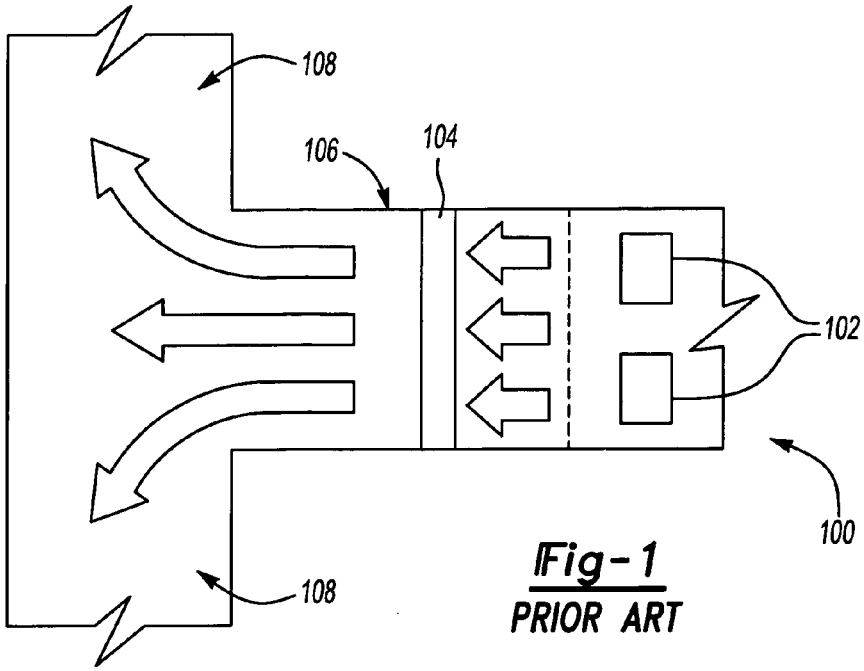
Fig-1 PRIOR ART
FIG. 1 is a representative diagram of a prior art ducted unit.
Figure 2:
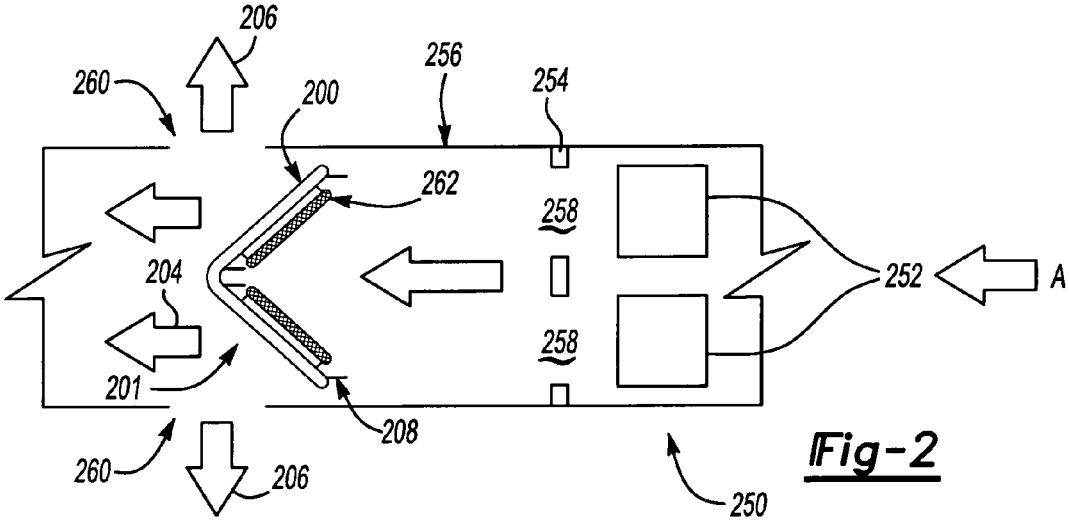
FIG. 2 is a perspective view of a ducted unit including a bent coil according to one embodiment of the invention.
Figure 3:
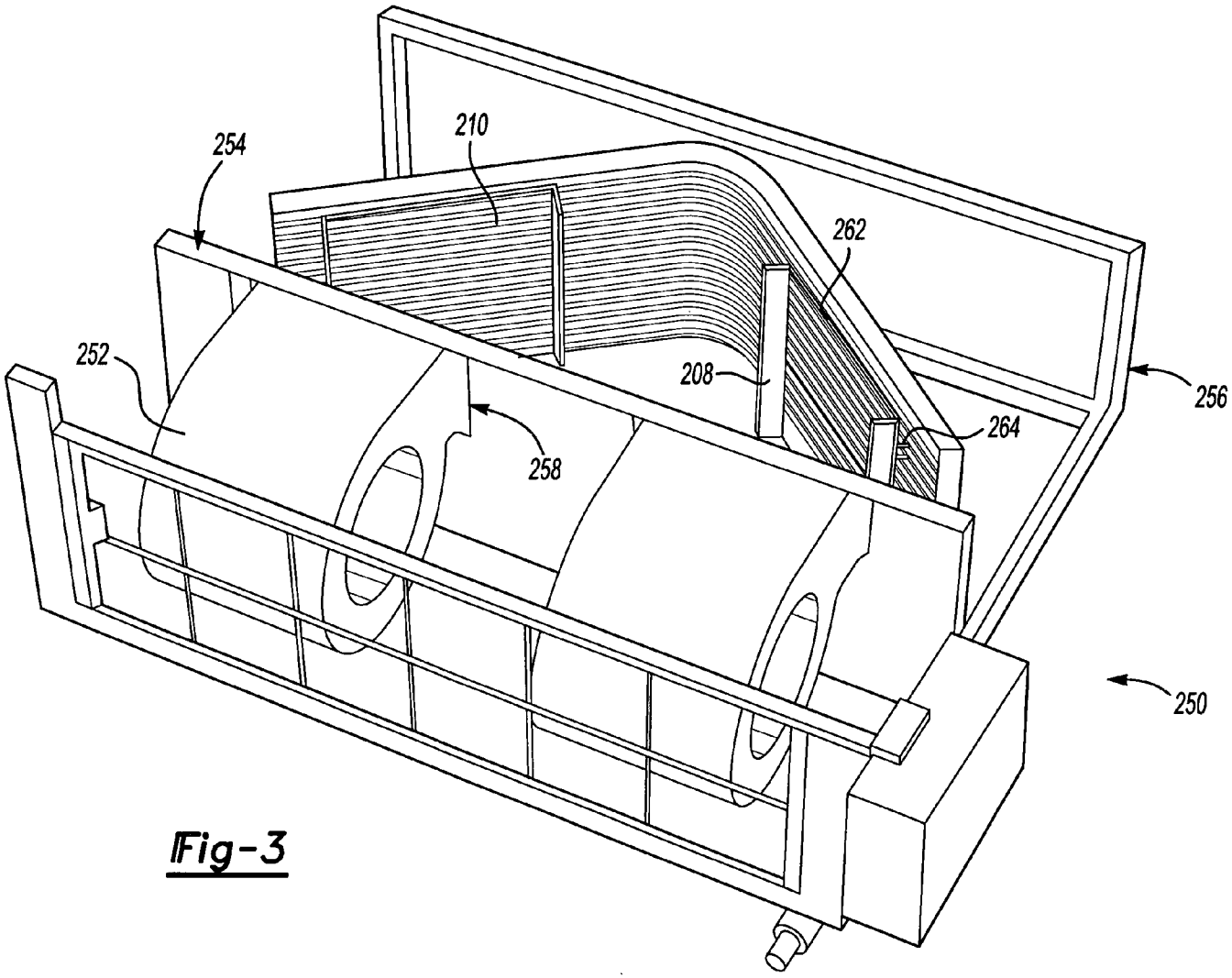
FIG. 3 is a perspective view of the ducted unit shown in FIG. 2.

FIGS. 2 and 3 illustrate a ducted unit 250 of the present invention including a bent coil 200. The bent coil 200 is a heat exchanger that heats or cools the air that flows through the bent coil 200. The bent coil 200 is bent rather than flat, creating more discharge surface area 201 than the flat coil 104 of the prior art for a given duct volume. The increased surface area optimizes the available volume within the ducted unit 250 and improves the heat exchange characteristics of the bent coil 200 by exposing more of the bent coil 200 surface to air. Thus, the bent coil 200 makes it possible to place a larger coil 200 within a given fixed duct volume.

Figure 4:
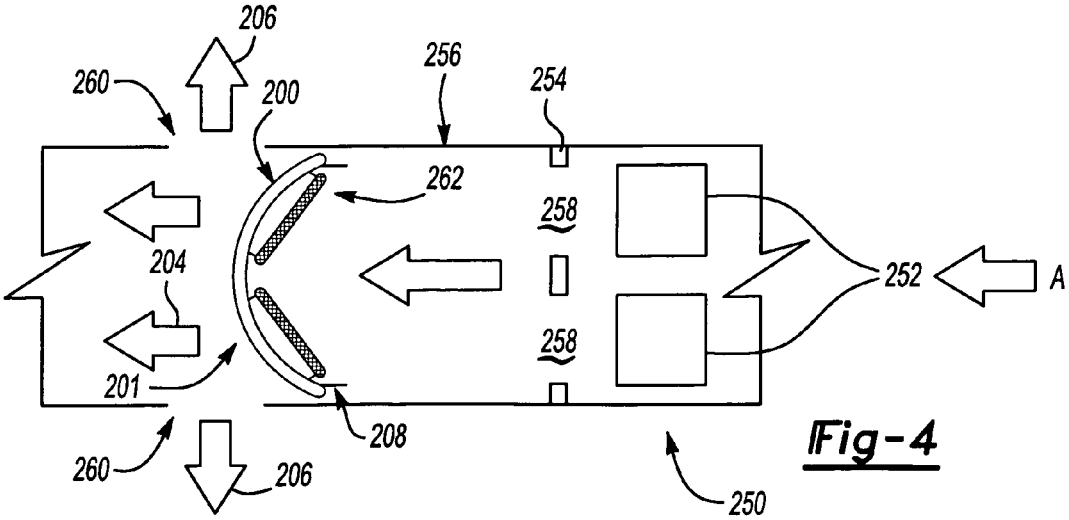
FIG. 4 is a top view of the ducted unit including a bent coil according to another embodiment of the invention.

The bent coil 200 can have many shapes. For example, as shown in FIGS. 2 and 3, the bent coil 200 can have a substantially V-shape. As shown in FIG. 4, the bent coil 200 can also have a curved profile. Of course, other non-linear bent coil 200 configurations are possible, such as a C-shape, M-shape, semi-circular shape, etc. without departing from the scope of the invention. Changing the profile of the bent coil 200 preserves the advantages of the bent coil 200 (e.g., maintenance accessibility, water drainage during cooling operations, etc.) while still improving the performance of the bent coil 200.

As can be seen in FIG. 2, air A moving through the ducted unit 250 that flows through the bent coil 200 will be directed laterally 206 as well as longitudinally toward the front 204 of the ducted unit 250. By orienting the discharge surface area 201 so at least a portion of the surface of the bent coil 200 is angled with respect to the usual, single longitudinal outlet air flow direction (as opposed to inclined with respect to a vertical axis of the ducted unit 250), the outlet air flow from the bent coil 200 will be multi-directional. Further, the bent shape of the bent coil 200 increases the surface area of the bent coil 200 for a given duct volume, increasing the heat exchange capabilities of the bent coil 200.

The ducted unit 250 includes two or more fans 252 and a separation wall 254 between the two or more fans 252 from the bent coil 200. In one example, two fans 252 are employed. The separation wall 254 includes separation wall openings 258 that aid in focusing the air flow from the fans 252 towards the bent coil 200, improving the air distribution and minimizing pressure lost. The air A moves from the two or more fans 252 towards the separation wall 254, through the separation wall openings 258, and towards the bent coil 200.

Figure 8:
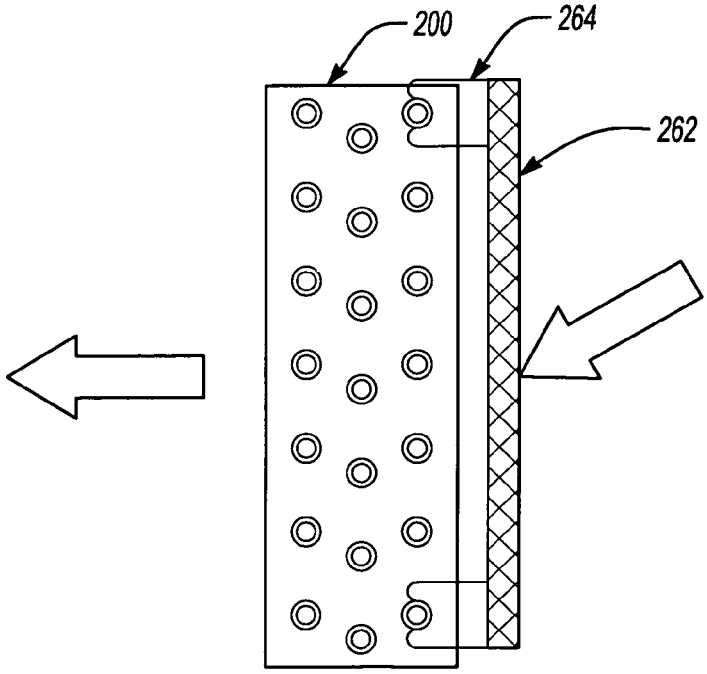
FIG. 8 is a section view of a typical airflow through the bent coil and a net.

The ducted unit 250 also includes a net 262 located between the separation wall 254 and the bent coil 200. The net 262 reduces the turbulence in the focused air flow as the air flow moves from the separation wall openings 258 and before entering the bent coil 200. As shown in FIG. 8, the net 262 reduces the turbulence of the air before it travels through the bent coil 200, evening the air distribution on the bent coil 200 and improving the heat exchange performance and the noise performance of the ducted unit 250. Preferably, the net 262 is made of nylon. The net 262 may be mounted on the bent coil 200 by tabs 264. The net 262 can be positioned on the bent coil 200 to minimize the turbulence of the inlet air.

Figure 5:
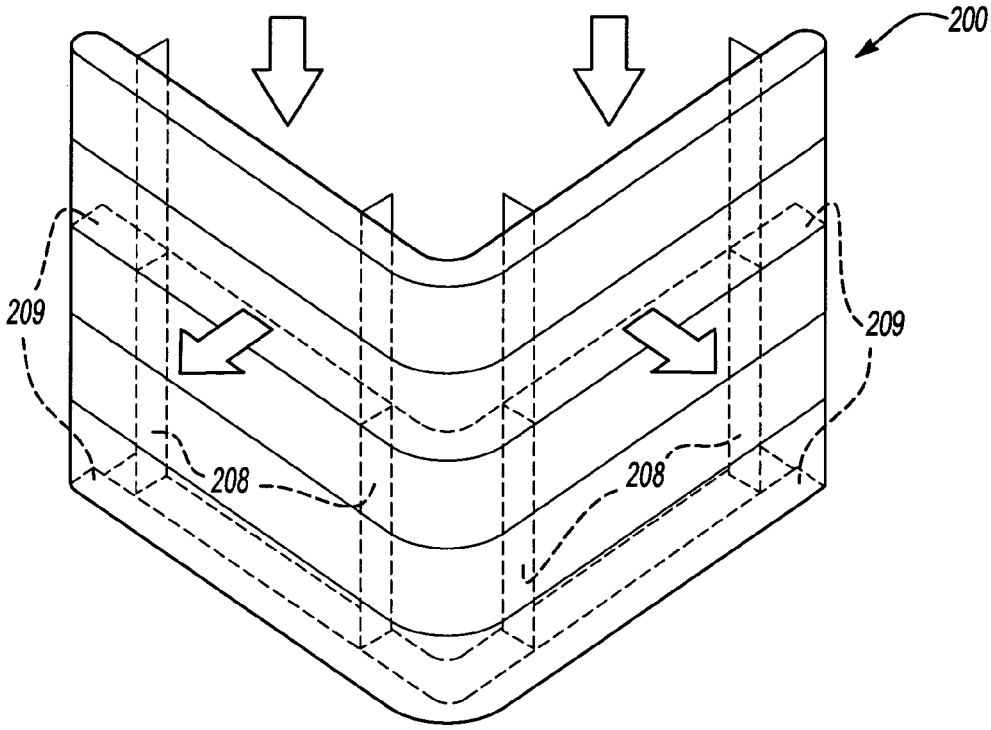
FIG. 5 is a perspective view of the bent coil shown in FIG. 2.
Figure 6:
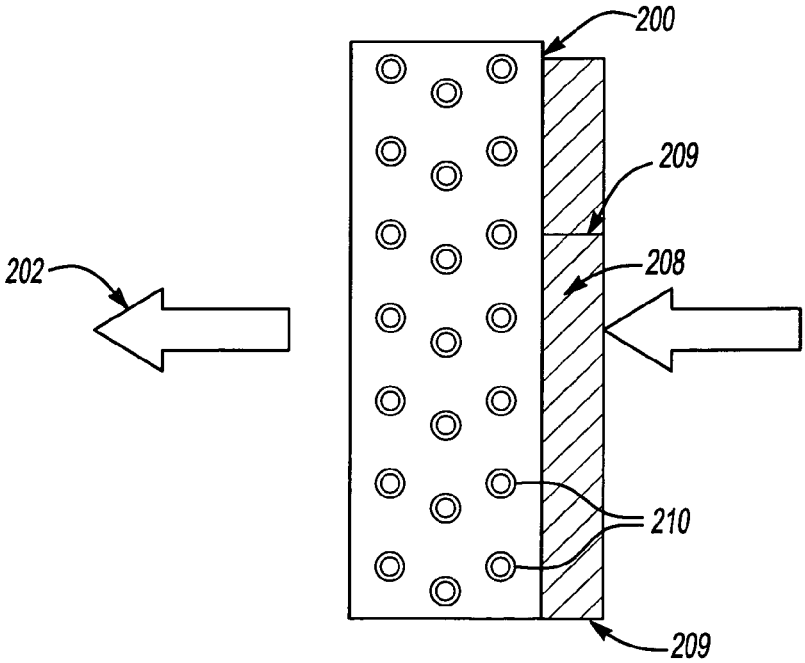
FIG. 6 is a section view of the bent coil shown in FIG. 5.

FIGS. 5 and 6 illustrate one embodiment of the inventive bent coil 200 in more detail. The structure can apply to any bent coil 200 configuration. In FIG. 5, the bent coil 200 includes at least one vertical fin 208 that guides air flow through the bent coil 200 in both the longitudinal and lateral directions, thereby reducing pressure losses normally associated with lateral flow and increasing the amount of air flowing through the bent coil 200.

Figure 7:
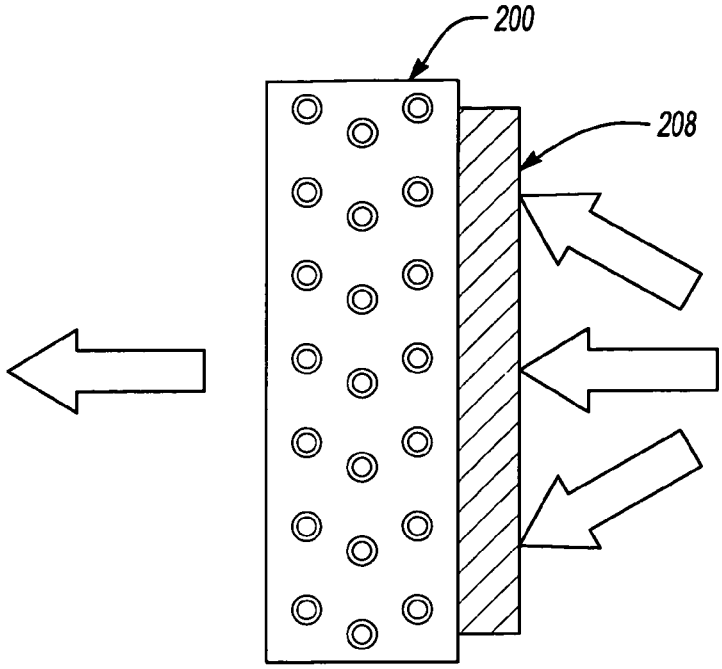
FIG. 7 is a section view of a typical airflow though the bent coil and vertical fins.

Maximizing air flow through the bent coil 200 improves the heat exchange performance. FIG. 7 is a section view of a typical airflow though the bent coil 200 and the vertical fin 208. The vertical fin 208 directs air flow through the bent coil 200 that, without the vertical fin 208, would move around the sides of the bent coil 200. The vertical fin 208 directs air in a direction that is substantially perpendicular to the bent coil 200 surface and through the bent coil 200. Although one vertical fin 208 is described, any number of substantially vertical fins 208 may be used to guide the air flow.

The bent coil 200 can also include at least one substantially horizontal fin 209 that functions in the same manner as the vertical fin 208. Any number of horizontal fins 209 may be used.

As shown in FIG. 6, the bent coil 200 also includes a plurality of tubes 210. In this embodiment the tubes 210 are aligned vertically and staggered horizontally with respect to each other, allowing air to flow between the tubes 210 and be exposed to the maximum amount of surface area of the tubes 210. The tubes 210 extend in a substantially horizontal direction. Fluid circulates within the tubes 210 to exchange heat with the unconditioned air flowing through the bent coil 200.

Note that in traditional flat coils 104, the tubes tend to be aligned both horizontally and vertically when the flat coil 104 is disposed at an incline with respect to a vertical axis in the duct 106. This allows air to flow past the tubes easily, but also causes the tubes closer to the front of the bent coil 200 to lie directly in front of tubes closer to the back of the bent coil 200, thereby blocking much of the surface area of the tubes closer to the back. The inventive bent coil 200 optimizes air distribution on the tubes 210 by taking full advantage of the staggering of tubes 210 that prevent any one tube 210 from falling within an aerodynamic shadow of another tube 210. The profile of the bent coil 200 ensures that a significant amount of surface area is exposed at different angles. For example, in the case of a V-shaped bent coil 200, portions of the front surface of the bent coil 200 can be seen from the sides as well as from the front. This further ensures that any air directed laterally 206 will not experience pressure or energy losses as it travels toward the sides of the bent coil 200.

A duct 256 houses at least the bent coil 200. As explained above, the bent coil 200 can direct outlet air 202 laterally 206 as well as longitudinally toward the front 204. As a result, the ducted unit 250 can include side discharge openings 260 in the duct 256 to allow the laterally-directed air to escape. The side discharge openings 260, in combination with the bent coil 200, eliminate the need for additional side ducts 108 to direct air laterally. The bent coil 200 itself directs air laterally due to the fin structure described above and not due to additional ducting, and air escaping the side discharge openings 260 does not experience any pressure losses due to the diversion.

The bent coil 200 therefore enables air delivery both in front of and to the sides of the bent coil 200 while maximizing surface area in all directions to optimize heat exchange between the bent coil 200 and the air flowing through the bent coil 200. Further, the ducted unit 250 incorporating the bent coil 200 does not required additional, space-consuming side ducts or other equipment downstream from the bent coil 200 to direct air laterally. Instead, the ducted unit 250 can simply include side discharge openings 260 instead of side ducts 108, relying upon the bent coil 200 and the vertical fin 208 to direct the air through the openings. As a result, the inventive bent coil 200 improves overall system efficiency, while providing a compact, easily installable configuration.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A ducted heating and cooling unit comprising:

two fans moving unconditioned air towards a bent coil;

the bent coil, wherein said unconditioned air flows through said bent coil and outlet air is discharged from said bent coil in a first direction and a second direction different than said first direction;

a separation wall including two openings, wherein said separation wall is located between said two fans and said bent coil and each of said two openings substantially align with one of said two fans; and a net disposed on said bent coil, wherein at least one tab attaches said net to said bent coil.

2. The ducted unit of claim 1, wherein said bent coil includes at least one first fin positioned within a flow of said unconditioned air.

3. The ducted unit of claim 2, wherein said at least one first fin is substantially vertical.

4. The ducted unit of claim 2, wherein said bent coil includes at least one second fin, wherein said at least one second fin is substantially transverse to said at least one first fin.

5. The ducted unit of claim 4, wherein said at least one second fin is substantially horizontal and said at least one first fin is substantially vertical.

6. The ducted unit of claim 1, wherein said net is nylon.

7. The ducted unit of claim 1, wherein said bent coil further comprises a plurality of tubes, wherein a fluid flows through said plurality of tubes to exchange heat with said unconditioned air flowing through said bent coil.

8. The ducted unit of claim 1, wherein said outlet air is discharged generally perpendicular to said bent coil.

9. The ducted unit of claim 1, wherein said first direction is generally longitudinal and said second direction is generally lateral.

10. The ducted unit of claim 1, further comprising a duct that houses said two fans, said bent coil and said separation wall, wherein said duct includes side openings, and said first direction of said outlet air flows through said side openings of said duct.

11. The ducted unit of claim 1, wherein said bent coil is a heat exchanger.

12. The ducted unit of claim 1, wherein said unconditioned air moves towards said separation wall in a substantially straight path.

13. A ducted heating and cooling unit comprising:

two fans moving unconditioned air towards a separation wall;

the separation wall, wherein said separation wall includes two openings that direct said unconditioned air to a bent coil;

the bent coil, wherein said unconditioned air flows through said bent coil and outlet air is discharged from said bent coil in a first direction and a second direction different than said first direction; and a net disposed on said bent coil, wherein at least one tab attaches said net to said bent coil.

14. The ducted unit of claim 13, wherein said net is nylon.

15. The ducted unit of claim 13, wherein said separation wall is located between said two fans and said bent coil and each of said two openings substantially align with one of said two fans.

16. The ducted unit of claim 13, further comprising a duct that houses said two fans, said bent coil and said separation wall, wherein said duct includes side openings, and said first direction of said outlet air flows through said side openings of said duct.

17. The ducted unit of claim 13, wherein said bent coil includes at least one first fin.

18. The ducted unit of claim 2, wherein said flow of said unconditioned airflow moves around said at least one first fin.

19. The ducted unit of claim 4, wherein said flow of said unconditioned airflow moves around said at least one second fin.

20. The ducted unit of claim 17, wherein said flow of said unconditioned airflow moves around said at least one first fin.

21. The ducted unit of claim 1, wherein a perimeter of each of said two openings substantially aligns with a perimeter of each of two fan openings.

22. The ducted unit of claim 13, wherein a perimeter of each of said two openings substantially aligns with a perimeter of each of two fan openings.

23. The ducted unit of claim 1, wherein said separation wall includes a central portion for impeding airflow to a bent portion of said bent coil.

24. The ducted unit of claim 13, wherein said separation wall includes a central portion for impeding airflow to a bent portion of said bent coil.

25. The ducted unit of claim 1, wherein a surface of said separation wall defines a surface transverse to said flow of said unconditioned airflow.

26. The ducted unit of claim 13, wherein a surface of said separation wall defines a surface transverse to said flow of said unconditioned airflow.

* * * * *